US010913273B2

(12) United States Patent
Orihara et al.

(10) Patent No.: US 10,913,273 B2
(45) Date of Patent: Feb. 9, 2021

(54) LIQUID EJECTING APPARATUS

(71) Applicant: SEIKO EPSON CORPORATION, Tokyo (JP)

(72) Inventors: Daichi Orihara, Nagano (JP); Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/575,561

(22) Filed: Sep. 19, 2019

(65) Prior Publication Data

US 2020/0094554 A1 Mar. 26, 2020

(30) Foreign Application Priority Data

Sep. 21, 2018 (JP) ..... 2018-177075

(51) Int. Cl.
*B41J 2/045* (2006.01)
*B41J 2/14* (2006.01)

(52) U.S. Cl.
CPC ..... *B41J 2/14233* (2013.01); *B41J 2/04571* (2013.01); *B41J 2/04573* (2013.01); *B41J 2/04581* (2013.01); *B41J 2/04588* (2013.01); *B41J 2/14274* (2013.01); *B41J 2/04541* (2013.01); *B41J 2/04593* (2013.01); *B41J 2202/11* (2013.01)

(58) Field of Classification Search
CPC ..... B41J 2/14233; B41J 2/04588; B41J 2/04581; B41J 2/04571; B41J 2/04573; B41J 2/14274; B41J 2/04593; B41J 2/04541; B41J 2202/11
See application file for complete search history.

(56) References Cited

U.S. PATENT DOCUMENTS

2005/0057596 A1* 3/2005 Shinkawa ..... B41J 2/16579 347/19
2016/0279929 A1* 9/2016 Shinkawa ..... B41J 2/04581

FOREIGN PATENT DOCUMENTS

JP 2011-189656 A 9/2011

* cited by examiner

*Primary Examiner* — Yaovi M Ameh
(74) *Attorney, Agent, or Firm* — Global IP Counselors, LLP

(57) ABSTRACT

A liquid ejecting apparatus includes a discharge portion provided with a piezoelectric element that is driven by a driving signal and a compression chamber that discharges a liquid from a nozzle according to the driving of the piezoelectric element, a detection unit detecting residual vibration occurring in the discharge portion, in a detection period after the piezoelectric element is driven and outputting a residual vibration signal indicating a waveform of the residual vibration, a specification unit specifying an initial time from a start time when the detection period starts to a reference time when a residual vibration signal becomes a signal level of a center of an amplitude after the start time of the detection period, and an estimation unit estimating a viscosity of the liquid in the compression chamber, based on the initial time.

5 Claims, 10 Drawing Sheets

FIG. 7

| Sd[m] | DESIGNATION CONTENT OF Sd[m] | Ga[m] | | Gb[m] | | | Gs[m] | | |
|---|---|---|---|---|---|---|---|---|---|
| | | Tu1 | Tu2 | TSS1 | TSS2 | TSS3 | TSS1 | TSS2 | TSS3 |
| 1 | LARGE DOT | H | H | L | L | L | L | L | L |
| 2 | MEDIUM DOT | H | L | L | L | L | L | L | L |
| 3 | SMALL DOT | L | H | L | L | L | L | L | L |
| 4 | NON-DISCHARGE | L | L | L | L | L | L | L | L |
| 5 | VISCOSITY ESTIMATION | L | L | H | L | H | L | H | L |

LIQUID EJECTING APPARATUS

The present application is based on, and claims priority from JP Application Serial Number 2018-177075, filed Sep. 21, 2018, the disclosure of which is hereby incorporated by reference herein in its entirety.

BACKGROUND

1. Technical Field

The present disclosure relates to a liquid ejecting apparatus.

2. Related Art

In a liquid ejecting apparatus such as an ink jet printer, as a piezoelectric element provided in a discharge portion of the liquid ejecting apparatus is driven by a driving signal, a liquid such as ink, which is filled in a compression chamber provided in the discharge portion, is discharged, so that an image is formed on a recording medium. The image quality of the image formed by such a liquid ejecting apparatus is affected by the viscosity of the liquid in the compression chamber. Therefore, in order to maintain good image quality of the image formed by the liquid ejecting apparatus, it is necessary to grasp the viscosity of the liquid in the compression chamber. For example, a technology, which specifies a time until residual vibration occurring in the discharge portion after the piezoelectric element is driven by the driving signal is attenuated and grasps viscosity of the liquid in the compression chamber based on a result of the specification, is disclosed in JP-A-2011-189656.

In the related art, the amplitude of residual vibration occurring in a discharge portion varies due to superposition or the like of noise on a driving signal. Then, when the amplitude of the residual vibration occurring in the discharge portion varies, a time until the residual vibration occurring in the discharge portion is attenuated also varies. Therefore, in the related art, it is difficult to accurately grasp the viscosity of liquid in a compression chamber.

SUMMARY

According to an aspect of the present disclosure, there is provided a liquid ejecting apparatus including a discharge portion provided with a piezoelectric element that is driven by a driving signal and a compression chamber that discharges a liquid from a nozzle according to the driving of the piezoelectric element, a detection unit detecting residual vibration occurring in the discharge portion, in a detection period after the piezoelectric element is driven and outputting a residual vibration signal indicating a waveform of the residual vibration, a specification unit specifying an initial time from a start time when the detection period starts to a reference time when a residual vibration signal becomes a signal level of a center of an amplitude after the start time of the detection period, and an estimation unit estimating a viscosity of the liquid in the compression chamber, based on the initial time.

BRIEF DESCRIPTION OF THE DRAWINGS

FIG. 7 is a diagram for illustrating an example of an individual designation signal.

DESCRIPTION OF EXEMPLARY EMBODIMENTS

Hereinafter, an aspect for carrying out the present disclosure will be described with reference to the accompanying drawings. However, in each drawing, the dimension and the scale of each component are appropriately different from the actual ones. Further, since the embodiment described below is a preferable specific example of the present disclosure, various technically preferable limitations are added. However, the scope of the present disclosure is not limited to the embodiment as long as there is no statement for particularly limiting the present disclosure in the following description.

A. EMBODIMENT

In the present embodiment, a liquid ejecting apparatus will be described by exemplifying an ink jet printer that forms an image on a recording paper sheet P by ejecting ink. In the present embodiment, the ink is an example of "liquid", and the recording paper sheet P is an example of a "medium".

1. Outline of Ink Jet Printer

Hereinafter, a configuration of an ink jet printer 1 according to the present embodiment will be described with reference to FIGS. 1 and 2.

Figure 1:
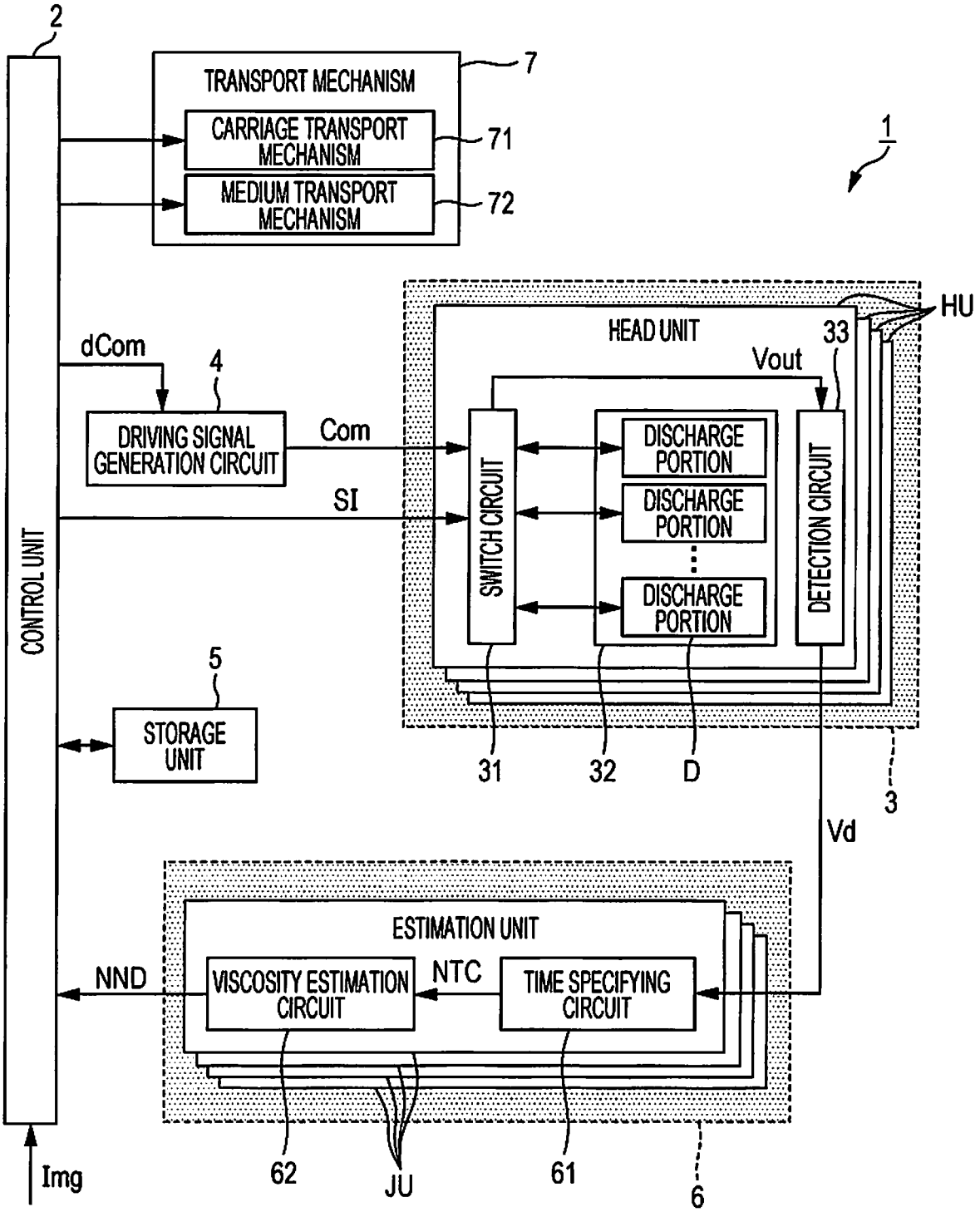
FIG. 1 is a block diagram showing an example of a configuration of an ink jet printer according to the present disclosure.

FIG. 1 is a block diagram showing functions of an example of a configuration of the ink jet printer 1. Printing data Img indicating an image to be formed by the ink jet printer 1 is supplied to the ink jet printer 1 from a host computer such as a personal computer or a digital camera. The ink jet printer 1 performs printing processing of forming, on the recording paper sheet P, an image represented by the printing data Img supplied from the host computer.

As shown in FIG. 1, the ink jet printer 1 includes a control unit 2 that controls each component of the ink jet printer 1, a head module 3 provided with a head unit HU in which a discharge portion D that ejects ink is provided, a driving signal generating circuit 4 that generates a driving signal Com for driving the discharge portion D, a storage unit 5 that stores various pieces of information, an estimation module 6 including an estimation unit JU that estimates the viscosity of the ink in the discharge portion D, and a transport mechanism 7 for changing a relative position of and the recording paper sheet P to the head module 3.

In the present embodiment, as shown in FIG. 1, a case where the head module 3 includes four head units HU and the estimation module 6 includes four estimation units JU corresponding to the four head units HU, respectively, is described as an example. Hereinafter, one head unit HU of the four head units HU and one estimation unit JU of the four estimation units JU, corresponding to the one head unit HU, will be described. However, this description is applied to the other head units HU and the other determination units JU in the same manner.

The control unit 2 includes a CPU. However, the control unit 2 may include a programmable logic device such as an FPGA instead of the CPU or in addition to the CPU. Here, the CPU is an abbreviation of a central processing unit, and the FPGA is an abbreviation of a field-programmable gate array. The control unit 2 causes the CPU to operate according to a control program stored in the storage unit 5 so as to generate a signal for controlling an operation of each component of the ink jet printer 1, such as a printing signal SI and a waveform designation signal dCom.

Here, the waveform designation signal dCom is a digital signal that defines a waveform of the driving signal Com.

Further, the driving signal Com is an analog signal that drives the discharge portion D. The driving signal generating circuit 5 includes a DA converting circuit, and generates the driving signal Com having a waveform defined by the waveform designation signal dCom. In the present embodiment, it is assumed that the driving signal Com includes a driving signal Com-A and a driving signal Com-B.

Further, the printing signal SI is a digital signal for designating the type of an operation of the discharge portion D. In detail, the printing signal SI is a signal that designates the type of the operation of the discharge portion D by designating whether or not the driving signal Com is supplied to the discharge portion D.

As shown in FIG. 1, the head unit HU includes a switch circuit 31, a recording head 32, and a detection circuit 33.

The recording head 32 includes M discharge portions D. Here, the value M is a natural number satisfying "M≥1". Hereinafter, an m-th discharge portion D among the M discharge portions D provided in the recording head 32 may be referred to as a discharge portion D[m]. Here, the variable m is a natural number satisfying "1≤m≤M". Further, in the following description, when a component or a signal of the ink jet printer 1 corresponds to the discharge portion D[m] among the M discharge portions D, the suffix [m] may be added to a reference numeral to represent the component, the signal, or the like.

The switch circuit 31 switches supply of the driving signal Com to the discharge portion D[m] based on the printing signal SI. Hereinafter, the driving signal Com supplied to the discharge portion D[m] among the driving signal Com may be referred to as a supply driving signal Vin[m]. Further, the switch circuit 31 switches supply, to the detection circuit 33, of a detection potential signal Vout[m] indicating a potential of an upper electrode Zu[m] of a piezoelectric element PZ[m] provided in the discharge portion D[m] based on the printing signal SI. The piezoelectric element PZ[m] and the upper electrode Zu[m] will be described below with reference to FIG. 3.

The detection circuit 33 generates a residual vibration signal Vd[m] based on the detection potential signal Vout [m]. The residual vibration signal Vd[m] represents a waveform of residual vibration that is vibration remaining in the discharge portion D[m] after the discharge portion D[m] is driven by the supply driving signal Vin[m]. The detection circuit 33 is an example of a "detection unit".

Further, as described above, as shown in FIG. 1, the ink jet printer 1 includes the estimation module 6 having the estimation unit JU that estimates the viscosity of the ink in the discharge portion D[m] based on the residual vibration signal Vd[m]. The estimation unit JU includes a time specifying circuit 61 and a viscosity estimating circuit 62.

The time specifying circuit 61 generates time information NTC indicating an initial time TK[m], which will be described below, based on the residual vibration signal Vd[m]. The time specifying circuit 61 is an example of a "specification unit".

The viscosity estimating circuit 62 estimates the viscosity of the ink existing inside the discharge portion D based on the time information NTC, and generates viscosity information NND indicating the estimated viscosity of the ink. The viscosity estimating circuit 62 is an example of an "estimation unit".

Hereinafter, processing related to the generation of the viscosity information NND in the estimation unit JU may be referred to as viscosity estimating processing. Further, in the following description, for the viscosity estimating processing, the discharge portion D[m], which is a target of detection of the detection potential signal Vout[m] by the detection circuit 33, may be referred to as the estimation target discharge portion D-S.

Figure 2:
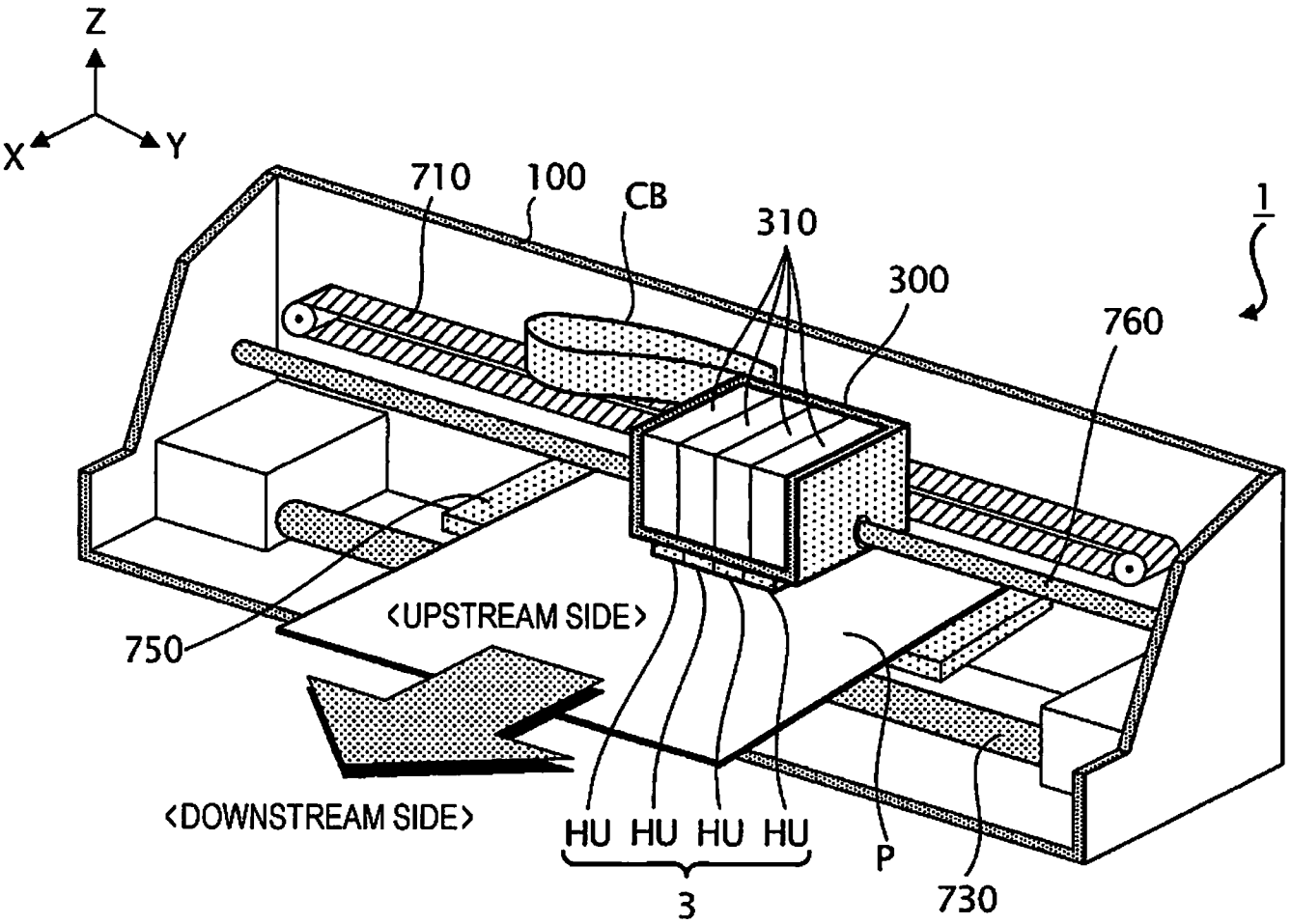
FIG. 2 is a perspective view showing an example of a schematic internal structure of the ink jet printer.

FIG. 2 is a perspective view showing an example of a schematic internal structure of the ink jet printer 1.

As shown in FIG. 2, in the present embodiment, a case where the ink jet printer 1 is a serial printer is assumed as an example. In detail, when performing the printing processing, in the ink jet printer 1, while the recording paper sheet P is transported in a sub scanning direction and the head module 3 reciprocates in a main scanning direction intersecting the sub scanning direction, the ink is discharged from the discharge portion D, so that dots corresponding to the printing data Img are formed on the recording paper sheet P.

Hereinafter, a +X direction and a −X direction that is opposite to the +X direction are collectively referred to as an "X axis direction", a +Y direction intersecting the X axis direction and a −Y direction that is opposite to the +Y direction are collectively referred to as an "Y axis direction", and a +Z direction intersecting the X axis direction and the Y axis direction and a −Z direction that is opposite to the +Z direction are collectively referred to as a "Z axis direction". Then, in the present embodiment, as shown in FIG. 2, a direction from a −X side that is an upstream side to a +X side that is a downstream side is defined as the sub scanning direction, and the +Y direction and the −Y direction are defined as the main scanning direction.

As shown in FIG. 2, the ink jet printer 1 according to the present embodiment includes a housing 100 and a carriage 300 on which the head module 3 that can reciprocate inside the housing 100 in the Y axis direction is mounted.

Further, as described above, the ink jet printer 1 according to the present embodiment includes a transport mechanism 7. When the printing processing is performed, the transport mechanism 7 changes the relative position of the recording paper sheet P to the head module 3 by causing the carriage 300 to reciprocate in the Y axis direction and transporting the recording paper sheet P in the +X direction, and thus can land the ink on the entire recording paper sheet P. As shown in FIG. 1, the transport mechanism 7 includes a carriage transporting mechanism 71 for causing the carriage 300 to reciprocate and a medium transporting mechanism 72 for transporting the recording paper sheet P. Further, as shown in FIG. 2, the transport mechanism 7 includes a carriage guide shaft 760 that supports the carriage 300 in the Y axis direction to reciprocate and a timing belt 710 fixed to the carriage 300 and driven by the carriage transporting mechanism 71. Therefore, the transport mechanism 7 can cause the head module 3 together with the carriage 300 to reciprocate along the carriage guide shaft 760 in the Y axis direction. Further, the transport mechanism 7 includes a platen 750 that is provided on a −Z side of the carriage 300 and a transport roller 730 that is rotated according to driving of the medium transporting mechanism 72 to transport the recording paper sheet P on the platen 750 in the +X direction.

In the present embodiment, as shown in FIG. 2, it is assumed that the carriage 300 includes four ink cartridges 310 corresponding to four colored inks of cyan, magenta, yellow, and black, respectively. Further, in the present embodiment, as an example, it is assumed that the four ink cartridges 310 are provided to correspond to the four head units HU, respectively. Each discharge portion D receives the ink from the ink cartridge 310 corresponding to the head unit HU to which the corresponding discharge portion D belongs. Accordingly, each discharge portion D can be filled with the supplied ink and can discharge the filled ink from a nozzle N. The ink cartridge 310 may be provided outside the carriage 300.

Here, an outline of an operation of the control unit 2 when the printing processing is performed will be described.

When the printing processing is performed, the control unit 2 first causes the storage unit 5 to store the printing data Img supplied from the host computer. Next, the control unit 2 generates a signal for controlling the head unit HU such as the printing signal SI, a signal for controlling the driving signal generating circuit 4 such as the waveform designation signal dCom, and a signal for controlling the transport mechanism 7, based on various pieces of data stored in the storage unit 5, such as the printing data Img. Then, the control unit 2 controls the driving signal generating circuit 4 and the switch circuit 31 to drive the discharge portion D while controlling the transport mechanism 7 to change the relative position of the recording paper sheet P to the head module 3, based on various signals such as the printing signal SI and various pieces of data stored in the storage unit 5. Accordingly, the control unit 2 adjusts presence and absence of the ink from the discharge portion D, a discharge amount of the ink, a discharge timing of the ink, and the like, and controls each component of the ink jet printer 1 to perform the printing processing of forming an image corresponding to the printing data Img on the recording paper sheet P.

Further, the ink jet printer 1 according to the present embodiment performs the viscosity estimating processing.

The viscosity estimating processing is a series of processing executed by the ink jet printer 1, which includes processing in which the control unit 2 selects the estimation target discharge portion D-S that is a target of the viscosity estimating processing, processing in which the driving signal generating circuit 4 generates the driving signal Com based on the waveform designation signal dCom output from the control unit 2, processing in which the switch circuit 31 drives the estimation target discharge portion D-S by supplying the driving signal Com output from the control unit 2 to the estimation target discharge portion D-S as the supply driving signal Vin under a control of the control unit 2, processing in which the detection circuit 33 generates the residual vibration signal Vd according to the detection potential signal Vout indicating the residual vibration occurring in the estimation target discharge portion D-S, processing in which the time specifying circuit 61 generates the time information NTC based on the residual vibration signal Vd, and processing in which the viscosity estimating circuit 62 estimates the viscosity of the ink existing inside the estimation target discharge portion D-S based on the time information NTC, and generates the viscosity information NND indicating the estimated viscosity of the ink.

2. Outline of Recording Head and Discharge Portion

The recording head 32 and the discharge portion D provided in the recording head 32 will be described with reference to FIGS. 3 and 4.

Figure 3:
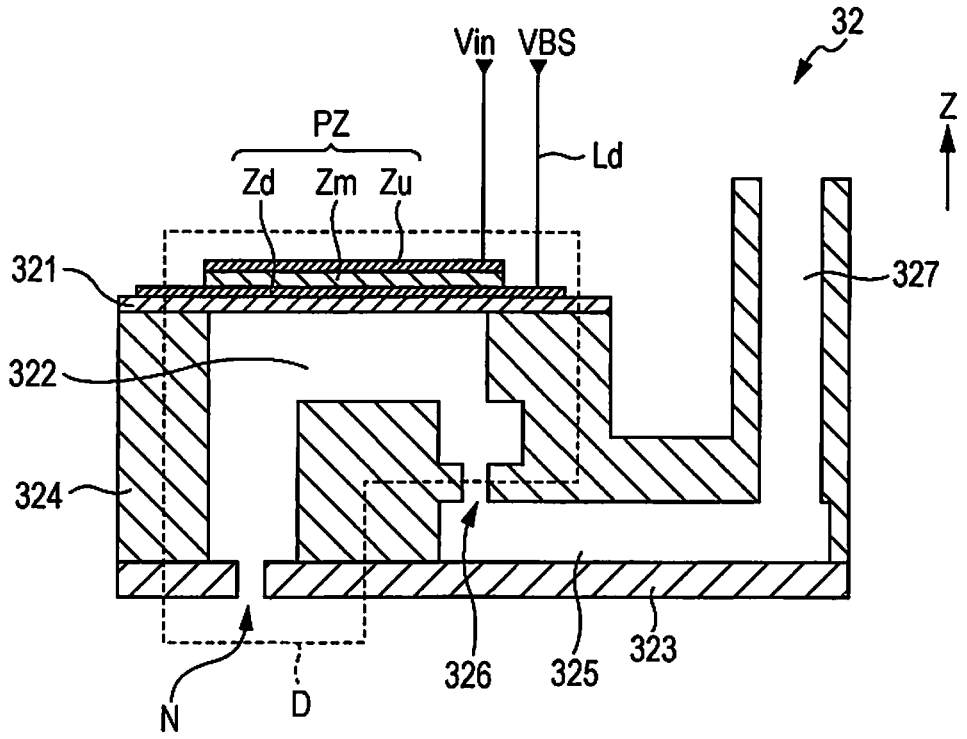
FIG. 3 is a diagram for illustrating an example of a structure of a discharge portion.

FIG. 3 is a schematic partial sectional view showing the recording head 32, obtained by cutting the recording head 32 to include the discharge portion D.

As shown in FIG. 3, the discharge portion D includes the piezoelectric element PZ, a cavity 322 filled with the ink, the nozzle N communicating with the cavity 322, and a diaphragm 321. Here, the cavity 322 is an example of a "compression chamber". The discharge portion D discharges the ink in the cavity 322 from the nozzle N by driving the piezoelectric element PZ using the supply driving signal Vin. The cavity 322 is a space defined by a cavity plate 324, a nozzle plate 323 in which the nozzle N is formed, and the diaphragm 321. The cavity 322 communicates with a reservoir 325 through an ink supply port 326. The reservoir 325 communicates with the ink cartridge 310 corresponding to the discharge portion D through an ink intake portion 327. The piezoelectric element PZ has an upper electrode Zu, a lower electrode Zd, and a piezoelectric body Zm provided between the upper electrode Zu and the lower electrode Zd. The lower electrode Zd is electrically connected to a feeding wire Ld set to a potential VBS. Then, when the supply driving signal Vin is supplied to the upper electrode Zu, and a voltage is applied between the upper electrode Zu and the lower electrode Zd, the piezoelectric element PZ is displaced in the +Z direction or the −Z direction according to the applied voltage, and as a result, the piezoelectric element PZ vibrates. The diaphragm 321 is installed at an upper opening portion of the cavity plate 324. The lower electrode Zd is joined to the diaphragm 321. Therefore, when the piezoelectric element PZ is driven and vibrated by the supply driving signal Vin, the diaphragm 321 also vibrates. Then, the volume of the cavity 322 and the pressure in the cavity 322 are changed by the vibration of the diaphragm 321, and the ink filled in the cavity 322 is discharged from the nozzle N.

Figure 4:
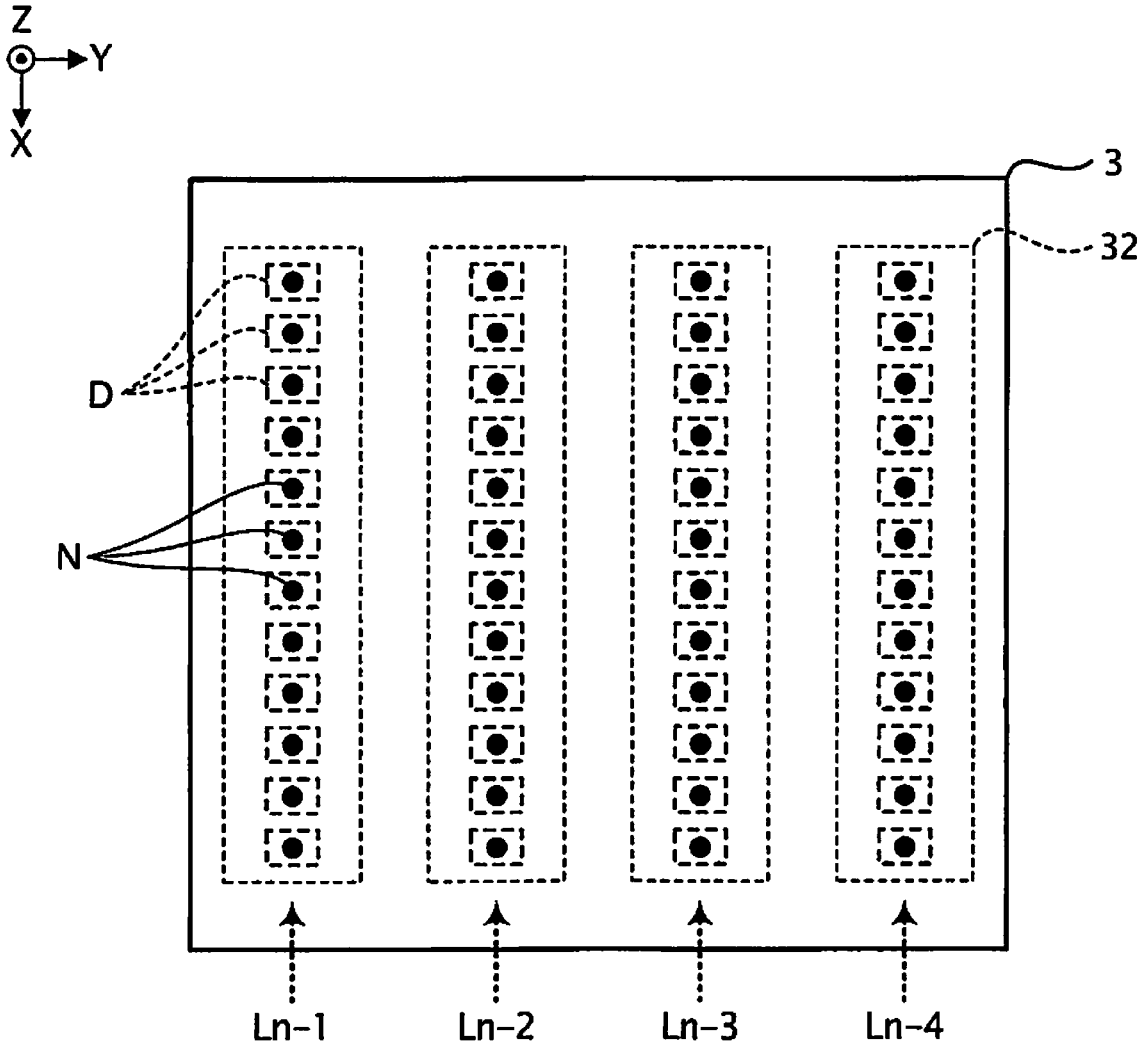
FIG. 4 is a plan view showing an example of arrangement of a nozzle of a head module.

FIG. 4 is a diagram for illustrating an example of arrangement of four recording heads 32 provided in the head module 3 and a total of 4M nozzles N provided in the four recording heads 32 when the ink jet printer 1 is viewed from the −Z direction in plan view. As shown in FIG. 4, each recording head 32 provided in the head module 3 is provided with a nozzle row Ln. Here, the nozzle row Ln is a plurality of nozzles N provided to extend in a row in a predetermined direction. In the present embodiment, it is assumed as an example that each nozzle row Ln includes M nozzles N arranged to extend in the X axis direction.

3. Configuration of Head Unit

Hereinafter, a configuration of each head unit HU will be described with reference to FIG. 5.

Figure 5:
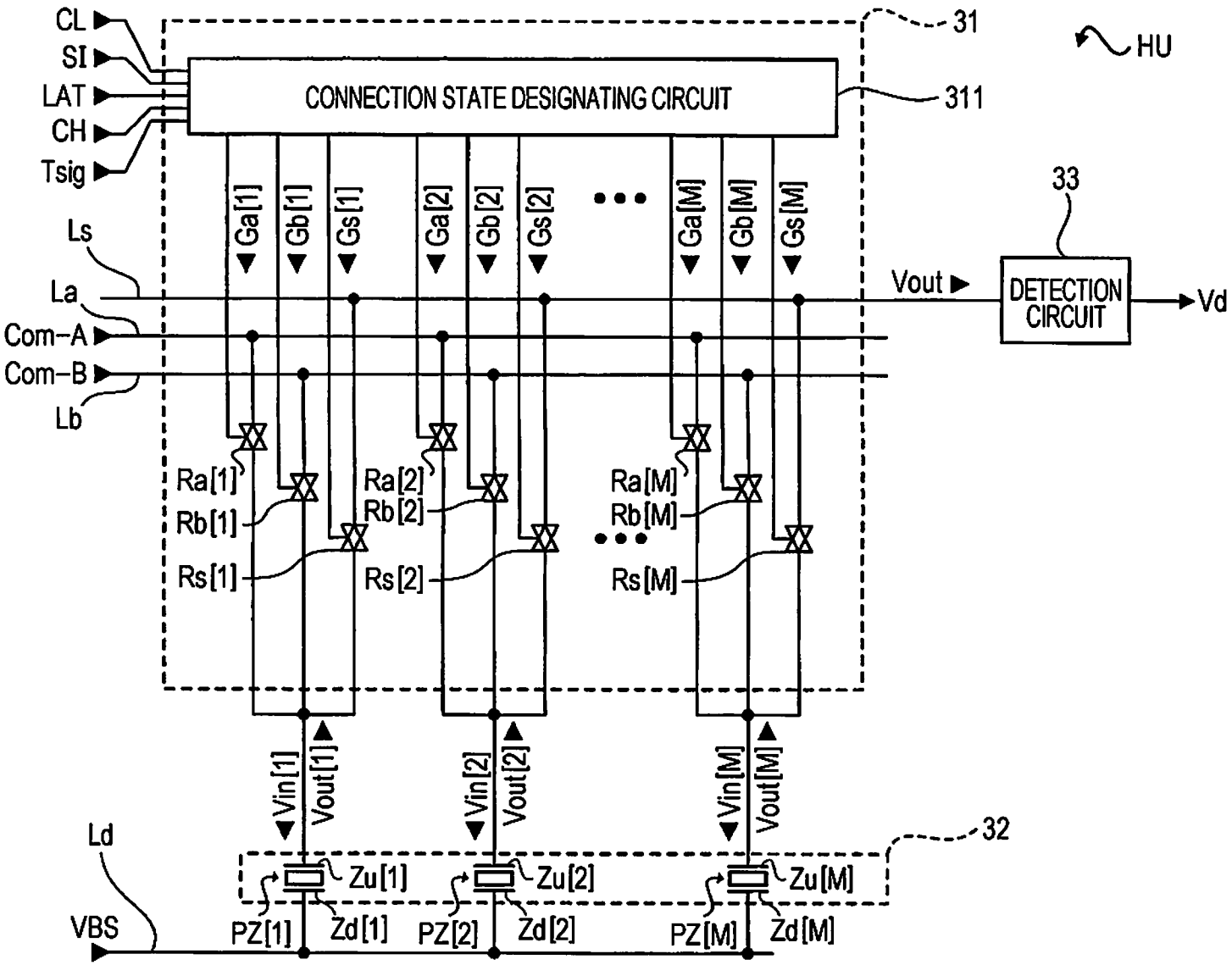
FIG. 5 is a block diagram showing an example of a configuration of a head unit.

FIG. 5 is a block diagram showing an example of the configuration of the head unit HU. As described above, the head unit HU includes the switch circuit 31, the recording head 32, and the detection circuit 33. Further, the head unit HU includes a wire La to which the driving signal Com-A is supplied from the driving signal generating circuit 4, a wire Lb to which the driving signal Com-B is supplied from the driving signal generating circuit 4, a wire Ls for supplying the detection potential signal Vout to the detection circuit 33, and the feeding wire Ld to which the potential VBS is supplied.

As shown in FIG. 5, the switch circuit 31 includes M switches Ra[1] to Ra[M], M switches Rb[1] to Rb[m], M switches Rs[1] to Rs[M], and a connection state designating circuit 311 that designates a connection state of each switch.

The connection state designating circuit 311 generates a connection state designating signal Ga[m] that designates an ON/OFF state of the switch Ra[m], a connection state designating signal Gb[m] that designates an ON/OFF state of the switch Rb[m], and a connection state designating signal Gs[m] that designates an ON/OFF state of the switch Rs[m], based on at least some of the printing signal SI, a latch signal LAT, a change signal CH, and a period defining signal Tsig supplied from the control unit 2.

Here, the switch Ra[m] switches conduction and non-conduction between the wire La and the upper electrode Zu[m] of the piezoelectric element PZ[m] provided in the discharge portion D[m], based on the connection state designating signal Ga[m]. In the present embodiment, the switch Ra[m] is switched on when the connection state designating signal Ga[m] is at a high level and is switched off when the connection state designating signal Ga[m] is at a low level. Further, the switch Rb[m] switches conduction and non-conduction between the wire Lb and the upper electrode Zu[m] of the piezoelectric element PZ[m] provided in the discharge portion D[m], based on the connection state designating signal Gb[m]. In the present embodiment, the switch Rb[m] is switched on when the connection state designating signal Gb[m] is at a high level and is switched off when the connection state designating signal Gb[m] is at a low level. Further, the switch Rs[m] switches conduction and non-conduction between the wire Ls and the upper electrode Zu[m] of the piezoelectric element PZ[m] provided in the discharge portion D[m], based on the connection state designating signal Gs[m]. In the present embodiment, the switch Rs[m] is switched on when the connection state designating signal Gs[m] is at a high level and is switched off when the connection state designating signal Gs[m] is at a low level.

As described above, the supply driving signal Vin[m] is a signal that is supplied to the piezoelectric element PZ[m] of the discharge portion D[m] through the switch Ra[m] or Rb[m] among the driving signals Com-A and Com-B.

The detection potential signal Vout[m] indicating the potential of the piezoelectric element PZ[m] of the discharge portion D[m] driven as the estimation target discharge portion D-S is supplied to the detection circuit 33 through the wire Ls. The detection circuit 33 generates the residual vibration signal Vd[m] based on the detection potential signal Vout[m].

4. Operation of Head Unit

Hereinafter, an operation of each head unit HU will be described with reference to FIGS. 6 and 7.

In the present embodiment, an operation period of the ink jet printer 1 includes one or more unit periods Tu. Further, the ink jet printer 1 according to the present embodiment can drive each discharge portion D for the printing processing in each unit period Tu. Further, the ink jet printer 1 according to the present embodiment can drive the estimation target discharge portion D-S in the viscosity estimating processing and detect the detection potential signal Vout from the estimation target discharge portion D-S, in each unit period Tu.

Figure 6:
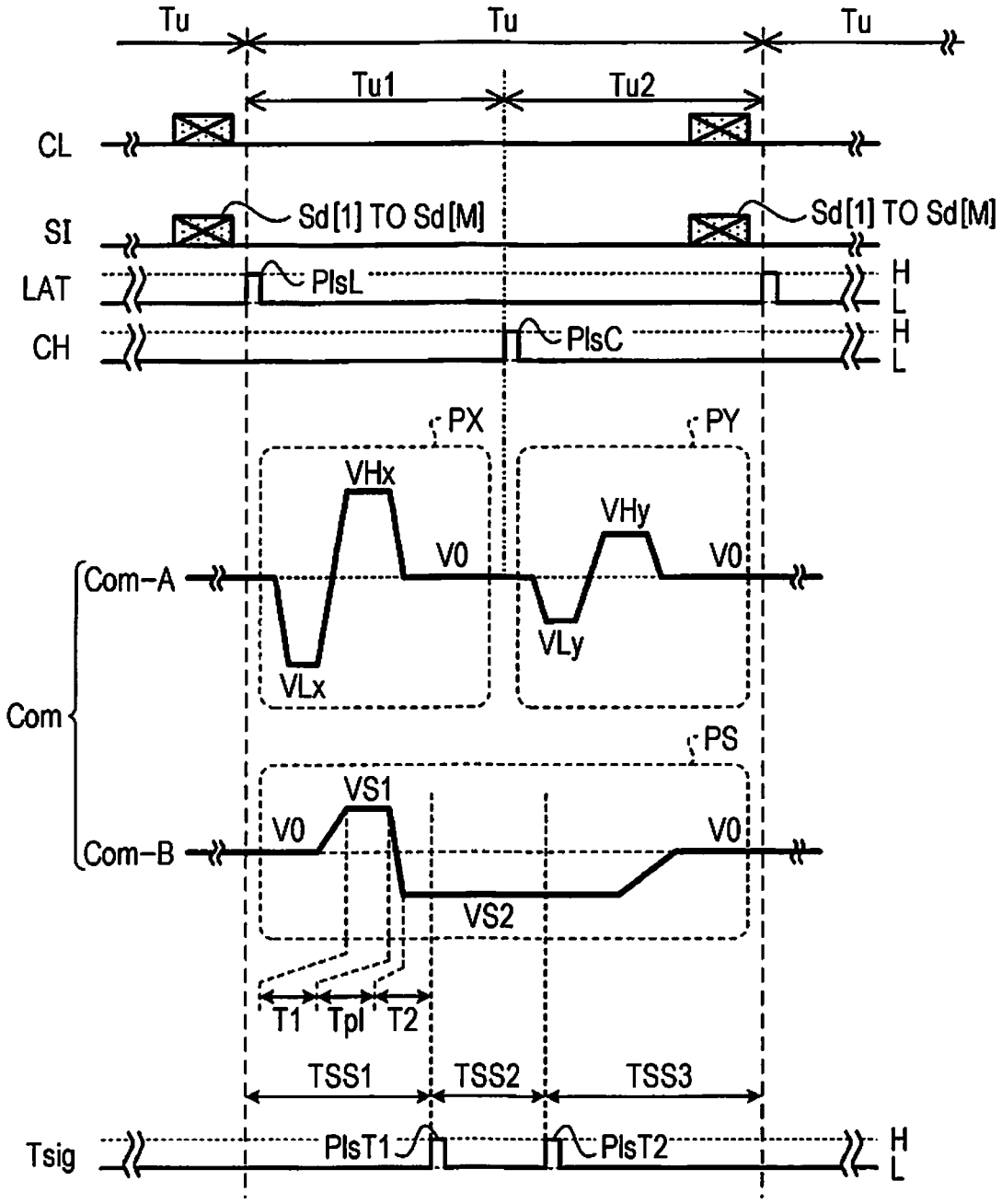
FIG. 6 is a timing chart for illustrating an example of an operation of the ink jet printer.

FIG. 6 is a timing chart showing an operation of the ink jet printer 1 in the unit period Tu.

As shown in FIG. 6, the control unit 2 outputs the latch signal LAT having a pulse PlsL. Accordingly, the control unit 2 defines the unit period Tu as a period from rising of the pulse PlsL to rising of the next pulse PlsL.

Further, the control unit 2 outputs the change signal CH having a pulse PlsC in the unit period Tu. Then, the control unit 2 divides the unit period Tu into a control period Tu1 from the rising of the pulse PlsL to rising of the pulse PlsC and a control period Tu2 from the rising of the pulse PlsC to the rising of the pulse PlsL.

Further, the control unit 2 outputs the period defining signal Tsig having a pulse PlsT1 and a pulse PlsT2 in the unit period Tu. Then, the control unit 2 divides the unit period Tu into a control period TSS1 from the rising of the pulse PlsL to rising of the pulse PlsT1, a control period TSS2 from the rising of the pulse PlsT1 to rising of the pulse PlsT2, and a control period TSS3 from the rising of the pulse PlsT2 to the rising of the pulse PlsL.

The printing signal SI according to the present embodiment includes individual designation signals Sd[1] to Sd[M] that designate driving modes of the discharge portions D[1] to D[M] in each unit period Tu. When the printing processing or the viscosity estimating processing is performed in the unit period Tu, as shown in FIG. 6, prior to the unit period Tu, the control unit 2 synchronizes the printing signal SI including the individual designation signals Sd[1] to Sd[M] with a clock signal CL to supply the synchronized printing signal SI to the connection state designating circuit 311. Then, the connection state designating circuit 311 generates the connection state designating signals Ga[m], Gb[m], and Gs[m], based on the individual designation signal Sd[m], in the unit period Tu.

In the present embodiment, it is assumed that the discharge portion D[m] can form a large dot, a medium dot that is smaller than the large dot, and a small dot that is smaller than the medium dot. Then, in the present embodiment, it is assumed that the individual designation signal Sd[m] can select any one of five values of a value "1" that designates driving of a mode in which the amount of the ink, corresponding to the large dot, is discharged to the discharge portion D[m], a value of '2" that designates driving of a mode in which the amount of the ink, corresponding to the middle dot, is discharged to the discharge portion D[m], a value of "3" that designates driving of a mode in which the amount of the ink, corresponding to the small dot, is discharged to the discharge portion D[m], a value of "4" that designates driving of a mode in which the ink is not discharged to the discharge portion D[m], and a value of "5" that designates driving of the estimation target discharge portion D-S with respect to the discharge portion D[m], in the unit period Tu.

As shown in FIG. 6, in the present embodiment, the driving signal Com-A has a waveform PX provided in the control period Tu1 and a waveform PY provided in the control period Tu2. In the present embodiment, the waveform PX and the waveform PY are defined such that a potential difference between the highest potential VHx and the lowest potential VLx of the waveform PX is larger than a potential difference between the highest potential VHy and the lowest potential VLy of the waveform PY. In detail, when the driving signal Com-A having the waveform PX is supplied to the discharge portion D[m], the waveform PX is determined such that the discharge portion D[m] is driven in the mode in which the amount of the ink, corresponding to the middle dot, is discharged. Further, when the driving signal Com-A having the waveform PY is supplied to the discharge portion D[m], the waveform PY is determined such that the discharge portion D[m] is driven in the mode in which the amount of the ink, corresponding to the small dot, is discharged. Further, in the present embodiment, the potentials of the waveform PX and the waveform PY at a start time and a termination time are set to a reference potential V0.

In the present embodiment, it is assumed as an example that, when the potential of the supply driving signal Vin[m] supplied to the discharge portion D[m] is a high potential, the volume of the cavity 322 of the discharge portion D[m] is smaller, as compared to a case where the potential of the supply driving signal Vin[m] is a low potential. Therefore, when the discharge portion D[m] is driven by the supply driving signal Vin[m] having the waveform PX, the potential of the supply driving signal Vin[m] is changed from the lowest potential VLx to the highest potential VHx, and thus the ink in the discharge portion D[m] is discharged from the nozzle N. Further, when the discharge portion D[m] is driven by the supply driving signal Vin[m] having the waveform PY, the potential of the supply driving signal Vin[m] is changed from the lowest potential VLy to the highest potential VHy, and thus the ink in the discharge portion D[m] is discharged from the nozzle N.

Further, in the present embodiment, the driving signal Com-B has the waveform PS. In the present embodiment, the waveform PS is a waveform that is the reference potential V0 at a time when the control period TSS1 starts, is maintained at a potential VS1 that is higher than the reference potential V0 during a period T1 among the control period TSS1, is changed from the potential VS1 to a potential VS2 that is lower than the reference potential V0 during a period Tp1 after the period T1 among the control period TSS1, is maintained at the potential VS2 during a period T2 after the period Tp1 among the control period TSS1, is maintained at the potential VS2 during the control period TSS2, and is changed from the potential VS2 to the reference potential V0 during the control period TSS3.

In the present embodiment, when the discharge portion D[m] is driven by the supply driving signal Vin[m] having the waveform PS, the volume of the cavity 322 of the discharge portion D[m] when the potential of the supply driving signal Vin[m] is the potential VS1 is smaller than the volume of the cavity 322 of the discharge portion D[m] when the potential of the supply driving signal Vin[m] is the potential VS2. In other words, in the present embodiment, when the discharge portion D[m] is driven by the supply driving signal Vin[m] having the waveform PS, the volume of the cavity 322 of the discharge portion D[m] is enlarged in the period Tp1 and the ink in the discharge portion D[m] is drawn in the +Z direction in the period Tp1.

Further, in the present embodiment, when the discharge portion D[m] is driven by the supply driving signal Vin[m] having the waveform PS, the waveform PS is determined such that the ink is not discharged from the discharge portion D[m].

In the present embodiment, a portion of the waveform PS, which corresponds to the control period TSS1, is an example of an "inspection waveform", the period T1 is an example of a "first period", the period T2 is an example of a "second period", the control period TSS2 is an example of a "detection period", the potential VS1 is an example of a "first potential", and the potential VS2 is an example of a "second potential".

FIG. 7 is a table for illustrating relationships between the individual designation signal Sd[m] and the connection state designating signals Ga[m], Gb[m], and Gs[m].

As shown in FIG. 7, when the individual designation signal Sd[m] indicates the value "1" that designates the driving of the mode in which the amount of the ink, corresponding to the large dot, is discharged to the discharge portion D[m] in the unit period Tu, the connection state designating circuit 311 sets the connection state designating signal Ga[m] to the high level during the unit period Tu. In this case, since the switch Ra[m] is switched on during the unit period Tu, the discharge portion D[m] is driven by the supply driving signal Vin[m] having the waveform PX and the waveform PY during the unit period Tu, to discharge the amount of the ink, corresponding to the large dot.

Further, as shown in FIG. 7, when the individual designation signal Sd[m] indicates, in the unit period Tu, the value "2" that designates the driving of the mode in which the amount of the ink, corresponding to the middle dot, is discharged to the discharge portion D[m], the connection state designating circuit 311 sets the connection state designating signal Ga[m] to the high level only during the control period Tu1. In this case, since the switch Ra[m] is switched on only during the control period Tu1, in the unit period Tu, the discharge portion D[m] is driven by the supply driving signal Vin[m] having the waveform PX, to discharge the amount of the ink, corresponding to the middle dot.

Further, as shown in FIG. 7, when the individual designation signal Sd[m] indicates, in the unit period Tu, the value "3" that designates the driving of the mode in which the amount of the ink, corresponding to the small dot, is discharged to the discharge portion D[m], the connection state designating circuit 311 sets the connection state designating signal Ga[m] to the high level only during the control period Tu2. In this case, since the switch Ra[m] is switched on only during the control period Tu2, in the unit period Tu, the discharge portion D[m] is driven by the supply driving signal Vin[m] having the waveform PY, to discharge the amount of the ink, corresponding to the small dot.

Further, as shown in FIG. 7, when the individual designation signal Sd[m] indicates, in the unit period Tu, the value "4" that designates the driving of the mode in which the ink is not discharged to the discharge portion D[m], the connection state designating circuit 311 sets the connection state designating signals Ga[m], Gb[m], and Gs[m] to the low level during the unit period Tu. In this case, the discharge portion D[m] is not driven by the driving signal Com in the unit period Tu, and does not discharge the ink.

As shown in FIG. 7, when the individual designation signal Sd[m] indicates, in the unit period Tu, the value "5" that designates the driving as the determination target discharge portion D-S with respect to the discharge portion D[m], the connection state designating circuit 311 sets the connection state designating signal Gb[m] to the high level in the control period TSS1 and the control period TSS3, and sets the connection state designating signal Gs[m] to the high level in the control period TSS2. In this case, the switch Rb[m] is switched on during the control period TSS1 and the control period TSS3, and the switch Rs[m] is switched on during the control period TSS2. That is, in this case, the discharge portion D[m] is driven by the supply driving signal Vin[m] having the waveform PS during the control period TSS1, and a state in which the residual vibration occurs in the discharge portion D[m] is created during the control period TSS2. That is, in this case, in the control period TSS2, the potential of the upper electrode Zu[m] of the discharge portion D[m] changes according to the residual vibration occurring in the discharge portion D[m]. Therefore, in this case, in the control period TSS2, the detection circuit 33 detects a detection potential signal Vout[m] based on the residual vibration occurring in the discharge portion D[m].

As described above, the detection circuit 33 generates the residual vibration signal Vd[m] based on the detection potential signal Vout[m]. In detail, the detection circuit 33 amplifies the detection potential signal Vout[m] and removes noise components to generate the residual vibration signal Vd[m] shaped into a waveform suitable for processing in the estimation unit JU.

5. Determination Unit

An outline of an operation of the estimation unit JU will be described with reference to FIGS. 8 to 10.

Figure 8:
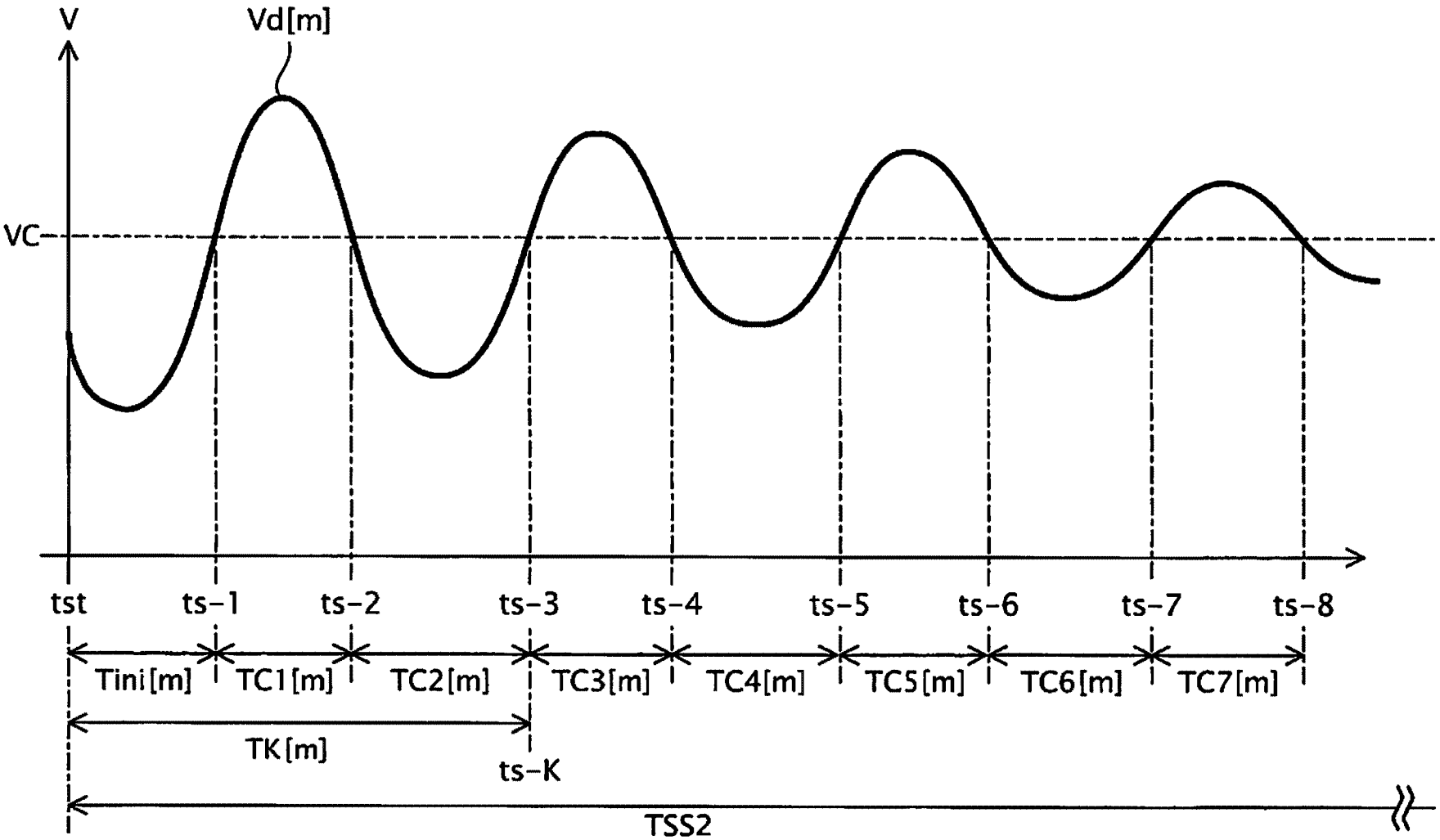
FIG. 8 is a diagram for illustrating an example of a residual vibration signal.

FIG. 8 is a diagram showing an example of the residual vibration signal Vd[m] supplied to the time specifying circuit 61 in the estimation unit JU. As described above, in the control period TSS2, the detection circuit 33 amplifies the amplitude of the detection potential signal Vout[m] indicating the residual vibration occurring in the discharge portion D[m] driven as the estimation target discharge portion D-S and removes noise components to generate the residual vibration signal Vd[m]. Therefore, the residual vibration signal Vd[m] indicates a waveform of the residual vibration occurring in the discharge portion D[m] in the control period TSS2.

Hereinafter, a time when the potential of the residual vibration signal Vd[m] coincides with a j-th potential VC is referred to as a time ts-j. Here, a variable j is a natural number satisfying "j≥1".

The time specifying circuit 61 compares the potential of the residual vibration signal Vd[m] with the potential VC at an amplitude center level of the residual vibration signal Vd[m] to specify the initial time TK[m] from a time tst when the control period TSS2 starts to a time ts-K based on a result of the comparison. Then, the time specifying circuit 61 outputs the time information NTC indicating the specified initial time TK[m]. Here, a constant K is a natural number satisfying "K≥1". In the present embodiment, the time tst is an example of a "starting time", and the time ts-K is an example of a "reference time".

In the present embodiment, a case where "K=3" is assumed as an example. That is, when a time from the time tst to a time ts-1 is referred to as an initial feature time Tini[m], and a time from the time ts-j to a time ts-(j+1) is referred to as a feature time TCj[m], the initial time TK[m] according to the present embodiment is expressed by Equation (1).

$$TK[m]=Tini[m]+TC1[m]+TC2[m] \quad (1)$$

However, the initial time TK[m] shown in Equation (1) is an example, and any one of Equations (2) to (4) may be adopted as the initial time TK[m]. That is, the initial time TK[m] may be at least a time determined based on the initial feature time Tini[m].

$$TK[m]=Tini[m] \quad (2)$$

$$TK[m]=Tini[m]+TC1[m] \quad (3)$$

$$TK[m]=Tini[m]+\{TC1[m]+\ldots+TC(K-1)[m]\} \quad (4)$$

A total time of a feature time TCj[m] and a feature time TC(j+1)[m] corresponds to a period of the residual vibration occurring in the discharge portion D[m]. Hereinafter, the period of the residual vibration occurring in the discharge portion D[m] may be referred to as a period TCS[m].

In general, the period TCS[m] of the residual vibration occurring in the discharge portion D[m] driven as the estimation target discharge portion D-S varies according to the viscosity of the ink filled in the cavity 322 of the discharge portion D[m]. In detail, when the viscosity of the ink filled in the cavity 322 of the discharge portion D[m] is high, the period TCS[m] is longer, as compared to a case where the viscosity is low. Then, the initial time TK[m] and the feature time TCj[m] are times determined according to the period TCS[m]. Therefore, when the viscosity of the ink filled in the cavity 322 of the discharge portion D[m] is high, the initial time TK[m] and the feature time TCj[m] are longer, as compared to a case where the viscosity is low.

Further, the period TCS[m] of the residual vibration occurring in the discharge portion D[m] varies according to a weight of the ink filled in the discharge portion D[m]. In detail, when the weight of the ink filled in the discharge portion D[m] is large, the period TCS[m] becomes longer, as compared to a case where the weight is small. In particular, the period TCS[m] is easily affected by the weight of the ink existing near the nozzle N among the ink filled in the discharge portion D[m].

Figure 9:
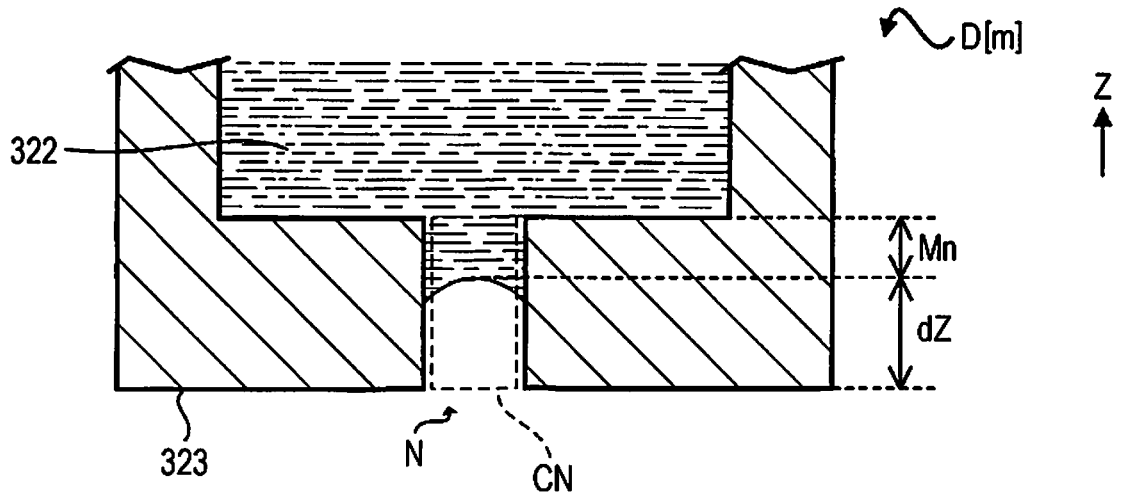
FIG. 9 is a diagram for illustrating a meniscus distance.

FIG. 9 is a diagram showing an example of a state of the vicinity of the nozzle N among the discharge portion D[m]. As shown in FIG. 9, a distance from a surface of the nozzle plate 323 on a −Z side to a meniscus surface that is a surface of the ink filled in the discharge portion D[m] on the −Z side is referred to as a meniscus distance dZ. Further, a mass of the ink existing in a nozzle channel CN causing the cavity 322 and the nozzle N to communicate with each other, among the ink filled in the discharge portion D[m], is referred to as an intra-channel ink mass Mm.

In general, an area of a cut surface of the nozzle channel CN when the nozzle channel CN is cut in a plane that is perpendicular to the Z axis direction is smaller than an area of a cut surface of the cavity 322 when the cavity 322 is cut in a plane that is perpendicular to the Z axis direction. That is, flow channel resistance of the nozzle channel CN is larger than flow channel resistance of the cavity 322. Therefore, even when the weight of the ink filled in the discharge portion D[m] is the same, the period TCS[m] varies according to the intra-channel ink mass Mn. In detail, when the intra-channel ink mass Mn is large, the period TCS[m] becomes longer, as compared to a case where the intra-channel ink mass Mn is small. That is, when the intra-channel ink mass Mn is large, the initial time TK[m] and the feature time TCj[m] become longer, as compared to a case where the intra-channel ink mass Mn is small.

Figure 10:
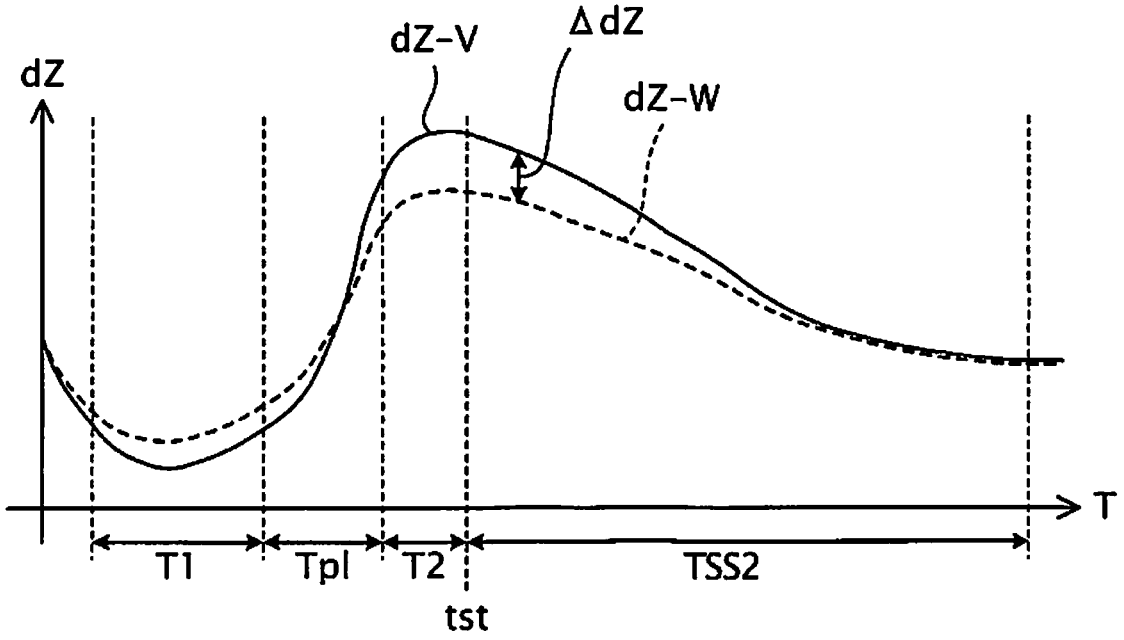
FIG. 10 is a diagram for illustrating an example of a change in the meniscus distance in a unit period.

FIG. 10 is a diagram showing an example of a change in the meniscus distance dZ related to the discharge portion D[m] driven as the estimation target discharge portion D-S in the unit period Tu. Among them, a normal-time meniscus distance dZ-V indicates the meniscus distance dZ when the ink filled in the discharge portion D[m] driven as the estimation target discharge portion D-S has a desired viscosity. Further, a viscosity-increasing-time meniscus distance dZ-W indicates the meniscus distance dZ when the viscosity of the ink filled in the discharge portion D[m] driven as the estimation target discharge portion D-S increases, and the viscosity of the ink filled in the discharge portion D[m] becomes higher than the desired viscosity. Hereinafter, an absolute value of a difference between the normal-time meniscus distance dZ-V and the viscosity-increasing-time meniscus distance dZ-W is referred to as a differential value ΔdZ. Further, hereinafter, when the ink filled in the discharge portion D[m] driven as the estimation target discharge portion D-S has the desired viscosity, the period TCS[m] of the residual vibration occurring in the discharge portion D[m] is referred to as a normal-time period TCS-V[m]. When the ink filled in the discharge portion D[m] driven as the estimation target discharge portion D-S has a viscosity that is higher than the desired viscosity, the period TCS[m] of the residual vibration occurring in the discharge portion D[m] is referred to as a viscosity-increasing-time period TCS-W[m]. Hereinafter, an absolute value of a difference between the normal-time period TCS-V[m] and the viscosity-increasing-time period TCS-W[m] is referred to as a differential value ΔTCS.

As described above, in the present embodiment, in the period Tp1, the ink filled in the discharge portion D[m] driven as the estimation target discharge portion D-S is drawn in the +Z direction. In other words, in the period TpL, the meniscus distance dZ increases. Then, when the viscosity of the ink filled in the discharge portion D[m] is low, the drawing amount of the ink in the period Tp1 becomes large, as compared to a case where the viscosity is high. That is, as shown in FIG. 10, the increase amount of the normal-time meniscus distance dZ-V in the period Tp1 is larger than the increase amount of the viscosity-increasing-time meniscus distance dZ-W in the period Tp1.

Further, as described above, in the present embodiment, the supply driving signal Vin[m] having the waveform PS, which is supplied to the discharge portion D[m] driven as the estimation target discharge portion D-S, is maintained at the potential VS2 in the period T2 and the control period TSS2. Therefore, in the control period TSS2, the normal-time meniscus distance dZ-V and the viscosity-increasing-time meniscus distance dZ-W decrease over time, and for example, converge to substantially the same distance at a termination time of the control period TSS2. In other words, the differential value ΔdZ decreases over time in the control period TSS2.

When the meniscus distance dZ is large, the intra-channel ink mass Mn becomes small, as compared to a case where the meniscus distance dZ is small. Then, when the intra-channel ink mass Mn is small, the period TCS[m] becomes short, as compared to a case where the intra-channel ink mass Mn is large. That is, when an elapsed time from the start time tst of the control period TSS2 is short, the differential value Δdz becomes large and the differential value ΔTCS also becomes large, as compared to a case where the elapsed time is long. In other words, as the elapsed time from the start time tst of the control period TSS2 becomes shorter, a viscosity increasing degree of the ink filled in the discharge portion D[m] driven as the estimation target discharge portion D-S can be reflected on the period TCS[m] with high accuracy. Therefore, the initial feature time Tini[m] is a value on which the viscosity increasing degree of the ink filled in the discharge portion D[m] is reflected with high accuracy, as compared to the feature time TCj[m]. That is, since the initial time TK[m] according to the present embodiment includes the initial feature time Tini[m], the initial time TK[m] can be set to a value on which the viscosity increasing degree of the ink filled in the discharge portion D[m] is reflected with high accuracy, as compared to a case where the initial time TK[m] does not include the initial feature time Tini[m].

The viscosity estimating circuit 62 estimates the viscosity of the ink filled in the discharge portion D[m] driven as the estimation target discharge portion D-S, based on the initial time TK[m] indicated by the time information NTC output from the time specifying circuit 61 and viscosity calculating information NSJ. Here, the viscosity calculating information NSJ, which is an example of "correspondence information", is information indicating a relationship between the initial time TK[m] and the viscosity of the ink filled in the discharge portion D[m]. In detail, the viscosity calculating information NSJ may be information indicating a coefficient of an equation obtained by linearly approximating a relationship between the viscosity of the ink filled in the discharge portion D[m] and the initial time TK[m], using the initial time TK[m] specified by filling the discharge portion D[m] with one ink having a known viscosity and driving the discharge portion D[m] as the estimation target discharge portion D-S and the initial time TK[m] specified by filling the discharge portion D[m] with another ink having a known viscosity that is different from the viscosity of the one ink and driving the discharge portion D[m] as the estimation target discharge portion D-S.

When estimating the viscosity of the ink filled in the discharge portion D[m] driven as the estimation target discharge portion D-S, the viscosity estimating circuit 62 outputs the viscosity information NND indicating a result of the estimation.

When outputting the printing signal SI designating that the discharge portion D[m] is driven as the estimation target discharge portion D-S, the control unit 2 stores the viscosity information NND obtained by the viscosity estimating circuit 62 in the storage unit 5, in association with the number "m" of the discharge portion D[m]. The control unit 2 may determine whether or not to perform cleaning for discharging the ink from the discharge portion D[m], based on the viscosity information NND, and may change the waveform of the driving signal Com to a waveform suitable for the viscosity of the ink filled in the discharge portion D[m].

6. Conclusion of Embodiment

As described above, in the present embodiment, the viscosity of the ink filled in the discharge portion D[m] is estimated based on the initial time TK[m] including the initial feature time Tini[m]. The initial feature time Tini[m] and the feature time TCj[m] are determined according to the period TCS[m] of the residual vibration occurring in the discharge portion D[m], and are not affected by the amplitude of the residual vibration. Therefore, according to the present embodiment, even when the amplitude of the residual vibration occurring in the discharge portion D[m] varies since noise is superimposed on the supply driving signal Vin[m] that is the driving signal Com supplied to the discharge portion D[m], the viscosity of the ink filled in the discharge portion D[m] can be estimated with high accuracy.

Further, in the present embodiment, the viscosity of the ink filled in the discharge portion D[m] is estimated based on the initial time TK[m] including the initial feature time Tini[m] starting from the time tst at which the control period TSS2 starts. That is, according to the present embodiment, the viscosity of the ink filled in the discharge portion D[m] is estimated based on the initial time TK[m] including the initial feature time Tini[m] detected in a period in which the differential value ΔTCS is relatively large among the control period TSS2. Therefore, according to the present embodiment, for example, as compared to a case where the viscosity of the ink filled in the discharge portion D[m] is estimated based on only the feature time TCj[m] after the initial feature time Tini[m] among the control period TSS2, accuracy of the estimation can be improved.

B. MODIFICATION EXAMPLE

The above embodiments may be variously modified. Detailed aspects of modification examples will be described below. Two or more aspects selected from the following description in a predetermined manner may be appropriately combined with each other within a range in which the aspects are not contradictory to each other. In the following modification example, an element having an effect or a function that is the same as that of the embodiment is designated by the above-described reference numeral, and detailed description thereof will be omitted.

Modification Example 1

In the above-described embodiment, the driving signal Com-B supplied to the estimation target discharge portion D-S has the waveform PS in which, in the period Tp1, the cavity 322 of the estimation target discharge portion D-S is enlarged and the ink in the estimation target discharge portion D-S is drawn in the +Z direction. However, the present disclosure may not be limited to such an aspect. The driving signal Com-B supplied to the estimation target discharge portion D-S may have a waveform in which, in the period Tp1, the ink in the estimation target discharge portion D-S is pushed out and discharged in the −Z direction.

Figure 11:
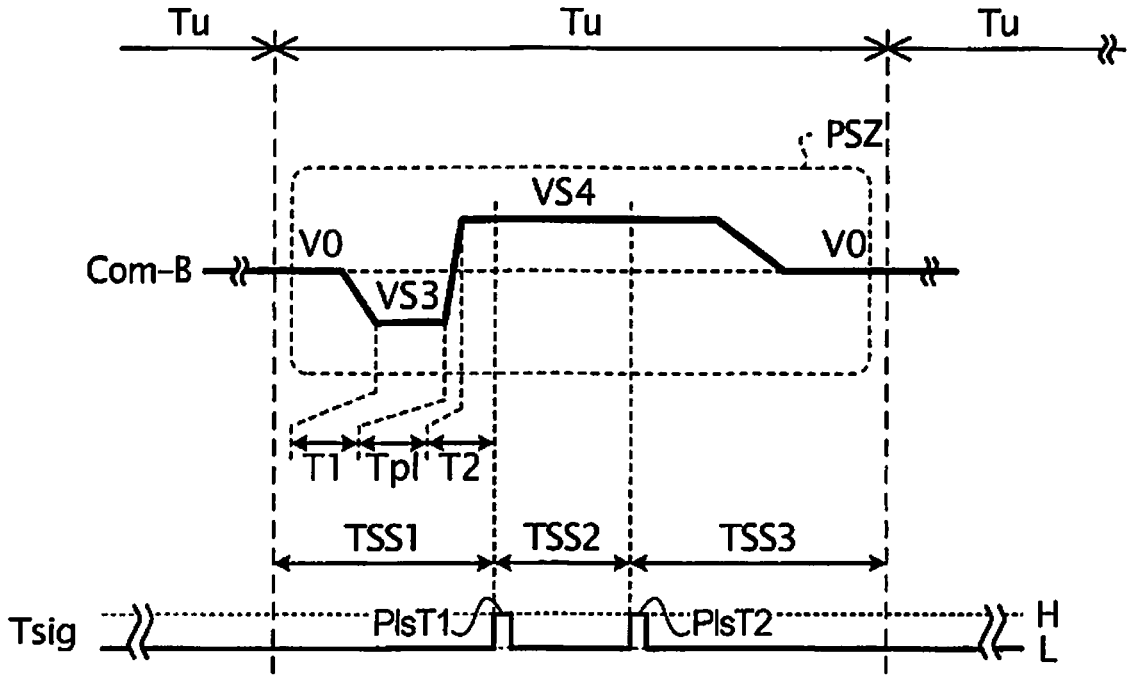
FIG. 11 is a timing chart for illustrating a waveform of a driving signal Com according to a modification example 1.

FIG. 11 is a diagram for illustrating a waveform of the driving signal Com-B according to the present modification example. As shown in FIG. 11, in the present modification example, the driving signal Com-B has a waveform PSZ. The waveform PSZ is a waveform that becomes the reference potential V0 at a time when the control period TSS1 starts, is maintained at a potential VS3 that is lower than the reference potential V0 in the period T1 of the control period TSS1, is changed from the potential VS3 to a potential VS4 that is higher than the reference potential V0 in the period Tp1 of the control period TSS1, is maintained at the potential VS4 in the period T2 of the control period TSS1, is maintained at the potential VS4 in the control period TSS2, and is changed from the potential VS4 to the reference potential V0 in the control period TSS3. Then, when the discharge portion D[m] is driven by the driving signal Com-B having the waveform PSZ, the volume of the cavity 322 of the discharge portion D[m] when the potential of the driving signal Com-B is the potential VS3 is larger than the volume of the cavity 322 of the discharge portion D[m] when the potential of the driving signal Com-B is the potential VS4. In the present modification example, it is assumed that when the discharge portion D[m] is driven by the driving signal Com-B having the waveform PSZ, in the period Tp1, the volume of the cavity 322 of the discharge portion D[m] is reduced, and in the period Tp1, the ink in the discharge portion D[m] is pushed out in the −Z direction and is discharged by the nozzle N. In the present modification example, a portion of the waveform PSZ, corresponding to the control period TSS1, is another example of the "inspection waveform", the potential VS3 is another example of the "first potential", and the potential VS4 is another example of the "second potential".

Figure 12:
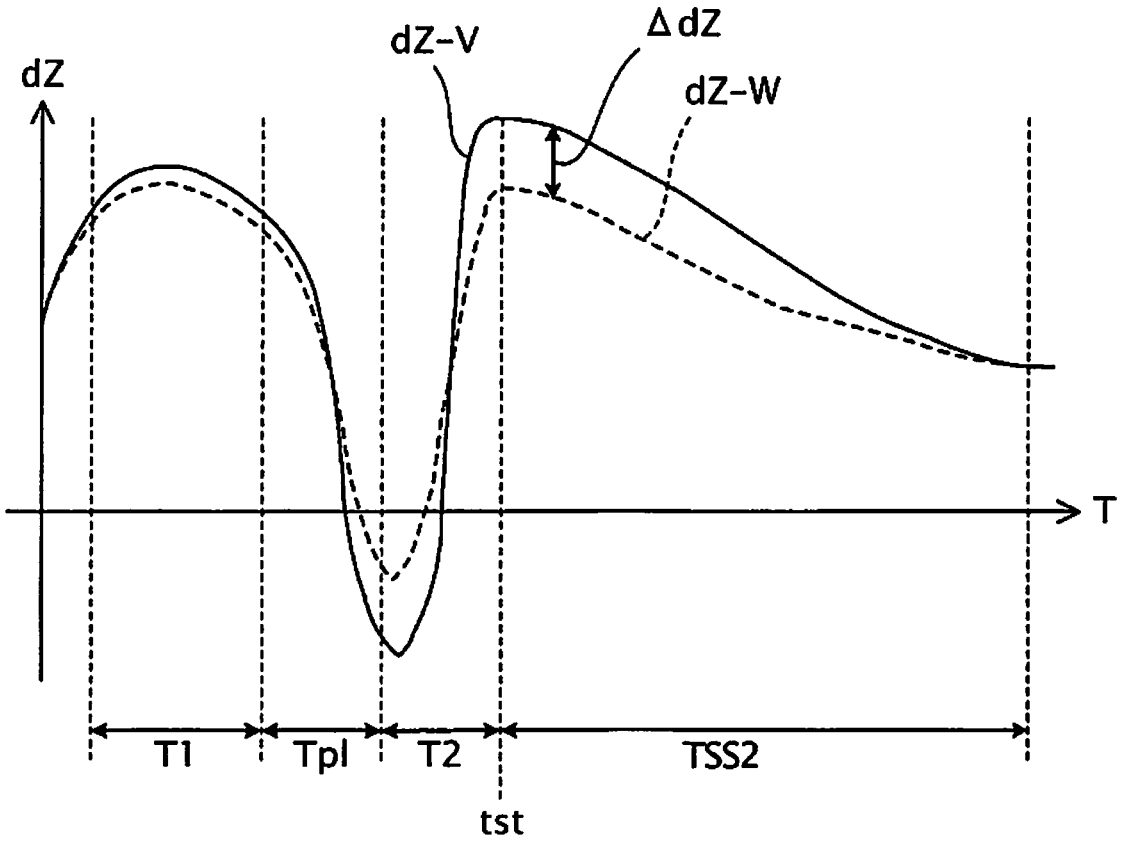
FIG. 12 is a diagram for illustrating an example of the change in the meniscus distance according to the modification example 1.

FIG. 12 is a diagram showing an example of a change in the meniscus distance dZ in the estimation target discharge portion D-S according to the present modification example, in the unit period Tu. As described above, in the present modification example, in the period Tp1, the ink filled in the estimation target discharge portion D-S is pushed out in the −z direction and is discharged from the nozzle N. Then, as shown in FIG. 12, when the viscosity of the ink filled in the estimation target discharge portion D-S is low, the pushing-out amount of the ink in the period Tp1 becomes large, as compared to a case where the viscosity is high. Therefore, when the viscosity of the ink filled in the estimation target discharge portion D-S is low, the discharge amount of the ink from the estimation target discharge portion D-S in the control period TSS1 becomes large, as compared to a case where the viscosity is high. Then, when the discharge amount of the ink from the estimation target discharge portion D-S is large, the intra-channel ink mass Mn at a timing after the ink is discharged from the estimation target discharge portion D-S becomes small, as compared to a case where the discharge amount is small. That is, as shown in FIG. 12, at the time tst when the control period TSS2 starts, the normal-time meniscus distance dZ-V is larger than the viscosity-increasing-time distance dZ-W.

Further, as described above, in the present modification example, the waveform PSZ is maintained at the potential VS4 in the period T2 and the control period TSS2. Therefore, in the control period TSS2, the normal-time meniscus distance dZ-V and the viscosity-increasing-time meniscus distance dz-W decrease over time, and for example, converge to substantially the same distance at the termination time of the control period TSS2. In other words, in the control period TSS2, the differential value ΔdZ between the normal-time meniscus distance dZ-V and the viscosity-increasing-time meniscus distance dZ-W decrease over time, and the differential value ΔTCS also decreases over time. Thus, even in the present modification example, as an elapsed time from the time tst when the control period TSS2 starts is shorter, a viscosity increasing degree of the ink filled in the estimation target discharge portion D-S can be reflected on the period TCS[m] with high accuracy. Thus, the initial feature time Tini[m] is a value on which the viscosity increasing degree of the ink filled in the discharge portion D[m] is reflected with high accuracy, as compared to the feature time TCj[m]. Thus, even in the present modification example, since the initial time TK[m] includes the initial feature time Tini[m], the initial time TK[m] may be a value on which the viscosity increasing degree of the ink filled in the discharge portion D[m] is reflected with high accuracy, as compared to a case where the initial time TK[m] does not include the initial feature time Tini[m].

Modification Example 2

In the above-described embodiment and the modification example 1, it is assumed that when the potential of the supply driving signal Vin[m] supplied to the discharge portion D[m] is high, the volume of the cavity 322 of the discharge portion D[m] becomes small, as compared to a case where the potential is low. However, the present disclosure is not limited to such an aspect. In the discharge portion D[m], when the potential of the supply driving signal Vin[m] supplied to the discharge portion D[m] is low, the piezoelectric element PZ[m] may be provided such that the volume of the cavity 322 of the discharge portion D[m] becomes small, as compared to a case where the potential is high.

Thus, the waveform PS according to the embodiment may be any waveform as long as the volume of the cavity 322 of the discharge portion D[m] in the period T2 becomes larger than the volume of the cavity 322 of the discharge portion D[m] in the period T1, and accordingly, the ink in the discharge portion D[m] in the period Tp1 is drawn in the +Z direction. In detail, when the potential of the supply driving signal Vin[m] supplied to the discharge portion D[m] is high, the waveform PS may be determined such that when the volume of the cavity 322 of the discharge portion D[m] becomes large, the potential VS1 in the period T1 is lower than the potential VS2 in the period T2, as compared to a case where the potential is low.

Further, the waveform PSZ according to the modification example 1 may be any waveform as long as the volume of the cavity 322 of the discharge portion D[m] in the period T2 is smaller than the volume of the cavity 322 of the discharge portion D[m] in the period T1, and accordingly, the ink in the discharge portion D[m] is pushed out in the −Z direction in the period Tp1. In detail, when the potential of the supply driving signal Vin[m] supplied to the discharge portion D[m] is high, the waveform PSZ may be determined such that when the volume of the cavity 322 of the discharge portion D[m] becomes large, the potential VS3 in the period T1 is higher than the potential VS4 in the period T2, as compared to a case where the potential is low.

Modification Example 3

In the above-described embodiment and the modification examples 1 and 2, the estimation unit JU is provided as a circuit separate from the control unit 2. However, the present disclosure is not limited to such an aspect. A part or the entirety of the estimation unit JU may be implemented as a functional block realized as the CPU or the like of the control unit 2 operates according to a control program.

Modification Example 4

In the above-described embodiment and the modification examples 1 to 3, the ink jet printer 1 is provided such that the four head units HU correspond to the four ink cartridges 310, respectively. However, the present disclosure is not limited to such an aspect. The ink jet printer 1 may include one or more head units HU and one or more ink cartridges 310.

Further, in the above-described embodiment and the modification examples 1 to 3, the estimation unit JU corresponding to each head unit HU is provided in the ink jet printer 1. However, the present disclosure is not limited to such an aspect. In the ink jet printer 1, one estimation unit JU may be provided for a plurality of head units HU and a plurality of estimation units JU may be provided for one head unit HU.

Modification Example 5

In the above-described embodiment and the modification examples 1 to 4, a case where the ink jet printer 1 is a serial printer is illustrated. However, the present disclosure is not limited to such an aspect. The ink jet printer 1 may be a so-called line printer in which the plurality of nozzles N are provided in the head module 3 to extend wider than the width of the recording paper sheet P.

What is claimed is:

1. A liquid ejecting apparatus comprising:

a discharge portion provided with a piezoelectric element that is driven by a driving signal and a compression chamber that discharges a liquid from a nozzle according to the driving of the piezoelectric element;

a detection unit detecting residual vibration occurring in the discharge portion, in a detection period after the piezoelectric element is driven, and outputting a residual vibration signal indicating a waveform of the residual vibration;

a specification unit specifying an initial time from a start time when the detection period starts to a reference time when a residual vibration signal becomes a signal level of a center of an amplitude after the start time of the detection period, by comparing a potential of the residual vibration signal with a potential at the center of the amplitude of the residual vibration signal, such that the initial time includes at least an initial feature time from the start time to a first time when the residual vibration signal firstly becomes the signal level of the center of the amplitude after the start time and a subsequent feature time that is subsequent to the initial feature time and is a time after the initial feature time and until a second time when the residual vibration signal secondly becomes the signal level of the center of the amplitude; and an estimation unit estimating a viscosity of the liquid in the compression chamber, based on the initial time.

2. The liquid ejecting apparatus according to claim 1, wherein the reference time is a time at which the residual vibration signal becomes the signal level of the center of the amplitude at three or more times after the start time of the detection period.

3. The liquid ejecting apparatus according to claim 1, wherein the detection period is a period provided after the piezoelectric element is driven by the driving signal having an inspection waveform, wherein the inspection waveform is a waveform in which a potential in a first period is a first potential and a potential in a second period after the first period is a second potential, and wherein a volume of the compression chamber measured when a potential of the driving signal for driving the piezoelectric element is the first potential is smaller than a volume of the compression chamber measured when the potential of the driving signal for driving the piezoelectric element is the second potential.

4. The liquid ejecting apparatus according to claim 1, wherein the detection period is a period provided after the piezoelectric element is driven by the driving signal having the inspection waveform and the liquid is discharged from the nozzle, wherein the inspection waveform is a waveform in which a potential in a first period is a first potential and a potential in a second period after the first period is a second potential, and wherein a volume of the compression chamber measured when a potential of the driving signal for driving the piezoelectric element is the first potential is larger than a volume of the compression chamber measured when the potential of the driving signal for driving the piezoelectric element is the second potential.

5. The liquid ejecting apparatus according to claim 1, wherein the estimation unit estimates the viscosity of the liquid in the compression chamber based on correspondence information for associating the initial time with the viscosity of the liquid in the compression chamber and the initial time.

* * * * *